United States Patent [19]

Sims et al.

[11] 4,424,859

[45] Jan. 10, 1984

[54] MULTI-CHANNEL FLUID INJECTION SYSTEM

[76] Inventors: Coleman W. Sims, P.O. Box 136, Boerne, Tex. 78006; W. P. Sims, 10040 Woodgrove Dr., Dallas, Tex. 75218

[21] Appl. No.: 318,187

[22] Filed: Nov. 4, 1981

[51] Int. Cl.[3] ..... E21B 33/124; E21B 33/127; E21B 41/00; E21B 43/24

[52] U.S. Cl. ..... 166/67; 166/75 A; 166/187; 166/191; 166/313; 166/377

[58] Field of Search ..... 166/242, 187, 191, 202, 166/57, 59, 313, 377, 380, 386, 387, 269, 67, 75 A; 175/215

[56] References Cited

U.S. PATENT DOCUMENTS

| | | | |
|---|---|---|---|
| 1,861,332 | 5/1932 | Waitz | 166/191 X |
| 1,876,627 | 9/1932 | Davis et al. | 175/215 X |
| 2,133,730 | 10/1938 | Brundred | 166/269 X |
| 2,584,606 | 2/1952 | Merriam et al. | 166/59 X |
| 2,647,585 | 8/1953 | Roberts | 166/187 X |
| 2,972,379 | 2/1961 | Brown | 166/202 X |
| 3,315,745 | 4/1967 | Rees, Jr. | 166/59 |
| 3,372,754 | 3/1968 | McDonald | 166/59 |
| 4,078,613 | 3/1978 | Hamrick et al. | 166/59 X |
| 4,134,619 | 1/1979 | Bunnelle | 175/215 X |

*Primary Examiner*—Stephen J. Novosad
*Attorney, Agent, or Firm*—Gerald G. Crutsinger; John F. Booth; Monty L. Ross

[57] ABSTRACT

Method and apparatus for introducing fluid into a wellbore through use of a multi-channel conduit.

1 Claim, 9 Drawing Figures

MULTI-CHANNEL FLUID INJECTION SYSTEM

TECHNICAL FIELD

This invention relates to an apparatus and method for injecting fluid into hydrocarbon-containing subsurface formations. One aspect of the invention relates to an apparatus useful for simultaneously transporting a fluid from a wellhead to a plurality of treatment zones within a wellbore. Another aspect of the invention relates to a method for simultaneously introducing fluid into each of several hydrocarbon-containing treatment zones within a single wellbore under controlled conditions.

BACKGROUND ART

It is well known throughout the oil well drilling industry that the rate at which liquid hydrocarbons are recovered from a subsurface formation can be increased by introducing or injecting any of several fluids into the formation. The use of water flooding or steam injection, for example, to stimulate production from a particular subsurface formation is widely known.

According to one technique that has proven particularly effective, a plurality of so-called injection wells are spaced around a producing well. Thus, when fluid is injected into a particular hydrocarbon-containing subsurface formation through each of the several injection wells, the hydrocarbons are driven by the pressure of the injected fluid toward the wellbore of the producing well, from which they are recovered.

It is also well known that a single wellbore may commonly pass through several hydrocarbon-containing subsurface formations. The physical characteristics, such as the depth, porosity, homogeneity, and sand thickness of each such formation may differ, as may the gravity, viscosity, and average molecular weight of the hydrocarbons present in each such formation. Because of these factors, it may be desirable to employ fluid at a particular flow rate, temperature and pressure in stimulating one zone and another combination of flow rate, temperature and pressure in stimulating another treatment zone in the same wellbore.

In the past, flooding or injection has frequently been attempted by perforating the casing in a wellbore at relatively close intervals over a range of depths spanning several producing zones. Pressurized fluid is then introduced into the casing near the top of the perforated range through a single channel conductor or conduit. However, when utilizing this injection method and apparatus, most of the fluid goes into the top few feet of the perforated zone, resulting in an inefficient and undesirable injection profile. Moreover, when a fluid is injected merely by introducing it under pressure into the wellbore, significant conductive heat loss occurs through the casing and well cement, and into the surrounding non-producing strata.

In an effort to overcome difficulties encountered with the foregoing method and apparatus, attempts have been made to control the flow of fluid to different production zones through the use of downhole flow regulators. Such regulators control the rates at which the fluid is released from a single channel conduit to various producing zones. Nevertheless, additional problems have been experienced with this method and apparatus. Monitoring the fluid flow into each zone is still difficult, and a wireline crew is needed in order to service or reposition the regulators.

Therefore, an apparatus and method are needed that will enable those working in the hydrocarbon production industry to more efficiently introduce fluid at different flow rates, temperatures and/or pressures to separate treatment zones within a single wellbore.

DISCLOSURE OF THE INVENTION

According to the present invention, an apparatus and method are now provided for introducing fluid through a wellbore into a plurality of hydrocarbon-containing subsurface formations. According to one embodiment of the invention, an apparatus is provided that comprises a multi-channel conduit adapted to simultaneously transport fluid from a wellhead to a plurality of treatment zones within a wellbore. The preferred apparatus of the invention further comprises a wellhead fitting communicating with the multi-channel conduit that is adapted to controllably release or inject fluid under pressure into at least two channels of the conduit for delivery to separate subsurface hydrocarbon-containing formations.

According to another embodiment of the invention, an apparatus is provided that is useful for simultaneously transporting fluids such as, for example, water, natural gas, carbon dioxide, steam, or other chemicals useful for well stimulation to several hydrocarbon-containing subsurface formations penetrated by a single wellbore.

According to another embodiment of the invention, an apparatus is provided that is useful for supplying fluids such as fuel gas, oxidizing gas and water to downhole steam generators.

According to another embodiment of the invention, an apparatus useful for injecting fluid into a plurality of hydrocarbon-containing subsurface formations is provided that comprises a plurality of extruded, multi-channel conduit segments connected in such manner that each channel communicates through a feed line vent port with that portion of the wellbore corresponding to a single treatment zone.

According to another embodiment of the invention, an apparatus for introducing fluid to a plurality of subsurface treatment zones is provided that comprises a multi-channel conduit for transporting the fluid, a wellhead fitting for controllably introducing the fluid into the conduit channels, and packing elements disposed above and below the feed line vent ports of the multi-channel conduit for partitioning different treatment zones within the wellbore.

According to another embodiment of the invention, an apparatus for injecting fluid into hydrocarbon-containing subsurface formations is provided that comprises a segmented multi-channel conduit, each segment of which further comprises a plurality of individual tubes nested within a cylindrical shell.

According to another embodiment of the invention, an apparatus is provided for connecting adjacent sections of multi-channel conduit adapted to transport fluid to a plurality of treatment zones within a single wellbore.

According to another embodiment of the invention, a back-off joint is provided that comprises a dual threaded collar having a left hand internal thread on one end and a right hand internal thread on the other end.

According to another embodiment of the invention, a method for introducing fluid through a wellbore into hydrocarbon-containing subsurface formations is provided that comprises the steps of emplacing in the wellbore a multi-channel conduit adapted to transport fluid from the surface to a plurality of distinct subsurface treatment zones, thereafter introducing fluid into at least two channels of the conduit at the wellhead, transporting fluid through the multi-channel conduit from the surface to the treatment zones, and releasing fluid from each fluid-containing channel to a different treatment zone.

According to another embodiment of the invention, a method for introducing fluid through a wellbore into multiple subsurface treatment zones is provided whereby the pressure and volume of the fluid delivered to each treatment zone is separately controlled from the surface of the wellbore.

The method and apparatus disclosed herein will for the first time permit fluid to be effectively and simultaneously injected at different flow rates, pressures, and/or temperatures into multiple treatment zones within a single wellbore without the need for downhole regulators, wireline crews, or the like. In its preferred embodiment, the apparatus of the invention permits maximum utilization of available space while minimizing undesirable downhole heat loss through the well casing to non-producing subsurface strata.

The method and apparatus disclosed herein require the use of no moving parts downhole other than the packing elements employed to partition that portion of the well bore associated with a particular treatment zone. With the present invention, all flow controls are located at the wellhead. Because all flow controls are located at the wellhead, flow rates and pressures may be changed when and as desired.

Moreover, the present method and apparatus can be utilized in existing wells where it has previously been possible to effectively treat only a single producing zone at a given time.

BRIEF DESCRIPTION OF DRAWINGS

The invention is explained in greater detail with reference to the accompanying drawings wherein.

DETAILED DESCRIPTION OF THE PREFERRED EMBODIMENTS

In a usual situation, as will be appreciated by those of ordinary skill in the art, injection wells and producing wells are interspersed in a grid-like pattern at a desirable spacing such as, for example, two and a half acres per well. Each well typically penetrates or traverses several layers of producing sands, each having a thickness of, for example, up to about 75 feet. In a conventional injection operation, the injected fluid is forced down the casing, through a perforation at the desired depth, and into the surrounding subsurface formation. Once inside the formation, the injected fluid operates in various ways to release the trapped hydrocarbons. In some cases, the higher temperature of the fluid heats the carbonaceous molecules, thereby reducing their viscosity so that they will flow more freely. Usually, the pressurized fluid drives the hydrocarbons in the direction of least resistance, and generally toward the producing well. Where carbon dioxide is used, the fluid swells and dissolves the hydrocarbons.

Using conventional methods and apparatus, several years may be required in order to deplete a single treatment zone to the point where it is no longer economically advantageous to continue injection. Moreover, since frequently only one zone is treated at a time by conventional practice, from 30 to 40 years may be required in order to separately treat and deplete each of the producing sands penetrated by a single producing well.

Through use of the present invention, however, the various producing formations traversed by a single wellbore can be injected simultaneously at carefully controlled low rates with efficient injection profiles, thereby significantly increasing the rate of recovery from the producing well and decreasing the time required to conclude the injection process.

Figure 1:
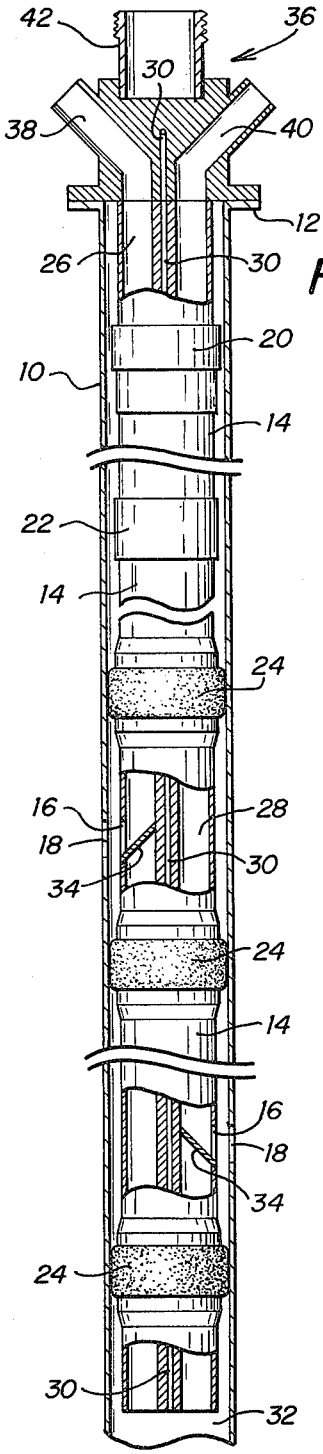
FIG. 1 is a sectional elevation view of a wellbore having the apparatus of the invention emplaced therein.

FIG. 1 is a sectional elevation view depicting in simplified form a well having the apparatus of the invention in place therein. Referring to FIG. 1, casing 10 is a conventional casing which has been cemented into a wellbore by conventional methods. Flange 12 extends above the surface (not shown) from casing 10 for attaching apparatus at the wellhead. Disposed inside casing 10 is multi-channel conduit 14 of the invention. Multi-channel conduit 14 is adapted to transport fluid downward from the surface through feed line vent ports 16 in the outer wall of multi-channel conduit 14, and when multi-channel conduit 14 is properly positioned, feed line vent ports 16 are desirably near or opposite perforations 18 in casing 10. The depths of perforations 18 in casing 10 correspond to the depths of the hydrocarbon-containing subsurface formations traversed by the wellbore.

In a preferred embodiment of the invention, the subject apparatus further comprises unions 20, back-off joints 22, and packing elements 24. To facilitate illustration, casing 10 and multi-channel conduit 14 have been sectioned and shortened. Nevertheless, it should be understood that numerous unions, 20, back-off joints 22, and packing elements 24 can be employed in a single well. Also, although only two fluid injection channels 26, 28, two feed line vent ports 16 and two casing perforations 18 are shown, the actual number desirable for a given application can vary and will depend on a variety of different factors, including by way of example, the number of subsurface formations to be treated, the diameter of casing 10, the diameter of multi-channel conduit 14, the depth of the hydrocarbon-containing formations, the nature and flow characteristics of the fluid being injected, and the like, as discussed in more detail below.

Packing elements 24 are desirably positioned between treatment zones, and most preferably, above and below feed line vent port 16 and the perforation 18 in casing 10 corresponding thereto so as to partition the annular space between casing 10 and multi-channel conduit 14. A fluid injected down fluid injection channel 26, 28 through feed line vent port 16 is thereby confined to that portion of casing 10 corresponding to the zone being treated. In FIG. 1, packing elements 24 are depicted in their "set" position against the inside wall of casing 10. When moving the string up down the hole, however, it is understood that packing elements 24 are "unset" or withdrawn from the inside wall of casing 10 so as to facilitate movement.

Multi-channel conduit 14 further comprises casing pressurization channel 30 through which the space 32 in casing 10 below the lowest packing element 24 can be pressurized from the surface so that packing elements 24 need only operate against the differential pressures between zones.

Feed line plugs 34 are preferably positioned in fluid injection channels 26, 28 below feed line vent ports 16 to block the downward flow of fluid through fluid injection channels 26, 28, to divert the fluid through feed line vent ports 16, and to assist in reducing flow turbulence. In some instances, however, it may be desirable to incorporate more than one feed line vent port 16 into a single channel of multi-channel conduit 14, and in such instances, a feed line plug 34 would only be utilized below the lowest feed line vent port 16. The use of more than one feed line vent port 16 in a single channel can be desirable where the thickness of a treatment zone requires the use of more than one injection point in order to achieve a satisfactory injection profile. Similarly, fluid can be injected into a particular treatment zone through feed line vent ports 16 of more than one channel of multi-channel conduit 14 where a greater flow rate than is attainable through one channel is desired.

Wellhead fitting 36 is positioned over multi-channel conduit 14 and connected by means of flange 12 to casing 10. A wellhead fitting of the general type shown is required for anchoring the multi-channel conduit at the wellhead. It also provides a means whereby fluid supply lines (not shown) can be conveniently connected to the appropriate fluid injection channel. Wellhead fitting 36 comprises fluid injection feed ports 38, 40 communicating with fluid injection channels 26, 28, respectively. Fluid injection feed ports 38, 40 can be used to introduce similar or dissimilar fluids into the various channels of multi-channel conduit 14. According to a preferred embodiment of the invention, the inlet ends of fluid injection feed ports 38, 40 communicate with a manifold (not shown) that supplies fluid from an external source. Furthermore, suitable commercially available regulator means (not shown) known to those of ordinary skill in the art can be employed at the wellhead for controlling the flow rate, pressure and temperature of the fluid introduced through fluid injection feed ports 38, 40. Different interrelationships will exist between the desired flow rate, temperature and pressure for different fluids and different applications depending on a variety of factors including, for example, whether the fluid is compressible or incompressible, internal geometry of the channels and feed line vent ports, depth of the treatment zone, specific gravity and viscosity of the fluid, and the like. Wellhead fitting 36 further comprises externally threaded member 42 for use in hoisting wellhead fitting 36 or all or a portion of multi-channel conduit 14 from the wellbore. Casing pressurization channel 30 communicates through wellhead fitting 36 to a casing pressurization source that is not shown.

Another channel serving as a pressurization source for packing elements 24 is preferably disposed in wellhead fitting 36 and multi-channel conduit 14 similarly to casing pressurization channel 30. The position and function of the packing element pressurization channel is discussed in further detail with regard to FIGS. 2, 3, 8 and 9 below.

Figure 8:
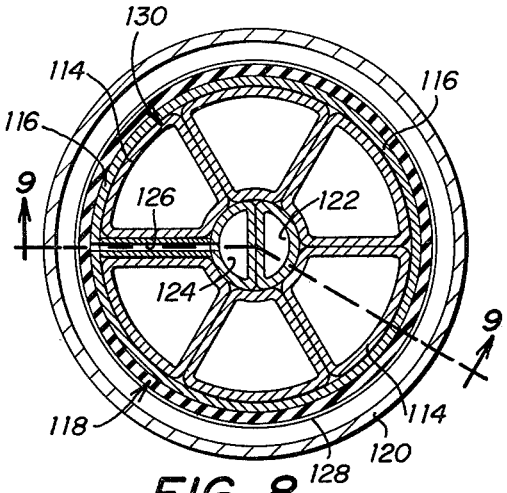
FIG. 8 is a sectional plan view of a multi-channel conduit comprising a plurality of smaller, individually formed tubes nested within a cylindrical shell.
Figure 9:
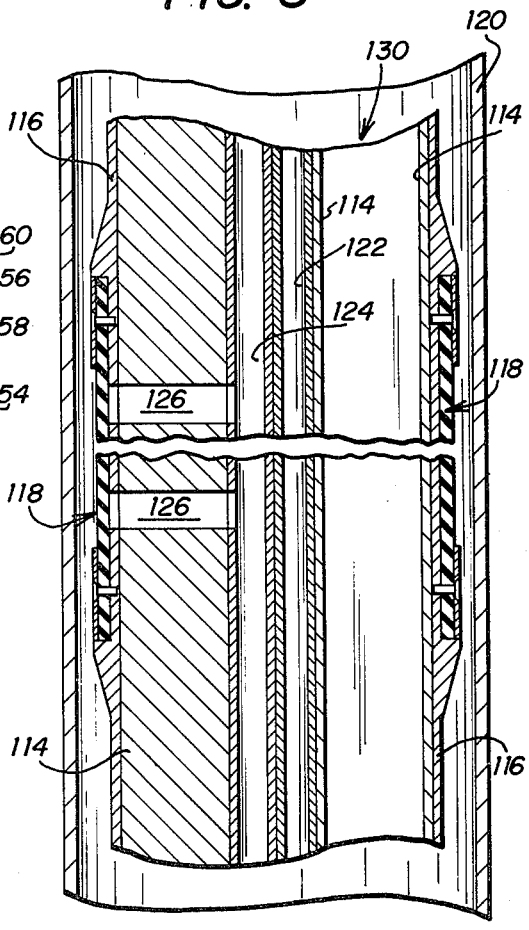
FIG. 9 is a sectional elevation view taken along line 9—9 of FIG. 8.

Depending upon factors such as the depth of the well, the downhole temperatures likely to be encountered, and the material used for making multi-channel conduit 14, the particular physical configuration utilized for multi-channel conduit 14 can vary within the scope of the present invention. Thus, FIGS. 2–3 depict a preferred embodiment suitable for use in relatively shallow wells whereas FIGS. 8 and 9 depict a preferred embodiment primarily intended for use in relatively deeper wells.

Figure 2:
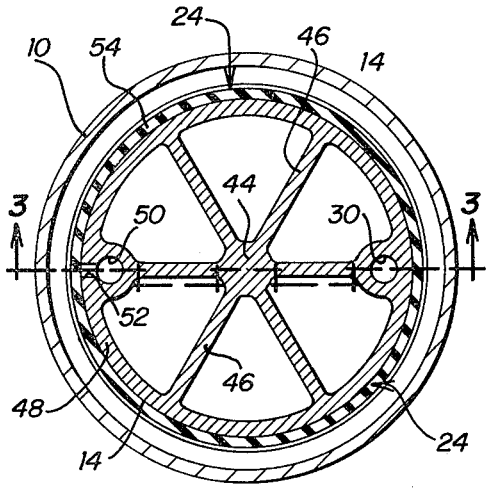
FIG. 2 is a sectional plan view of a wellbore containing a unitary multiple-channel conduit and packing element according to one embodiment of the invention.
Figure 3:
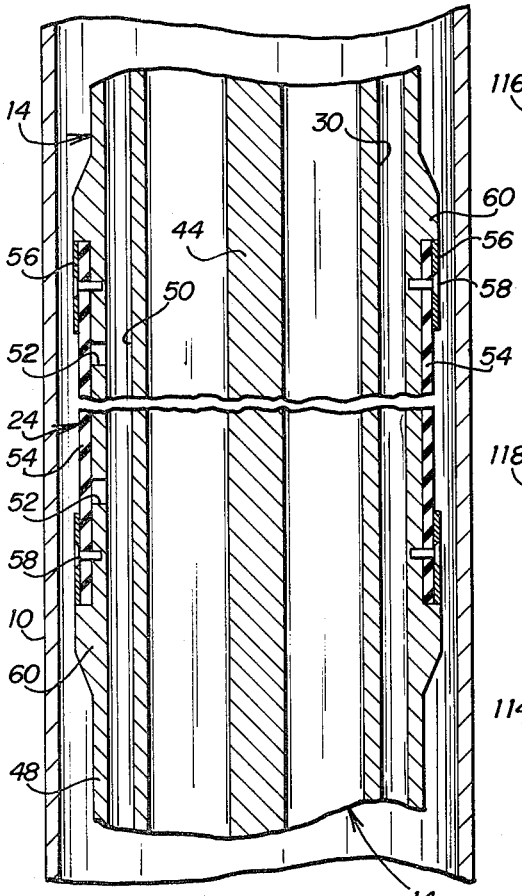
FIG. 3 is a sectional elevation view taken along line 3—3 of FIG. 2.

FIGS. 2 and 3 depict a multi-channel conduit 14 disposed within packing element 24, which is in turn disposed within casing 10. According to a preferred embodiment of the invention, multi-channel conduit 14 is a substantially cylindrical extrudate having a multiplicity of discrete longitudinal channels of relatively constant cross-section disposed therein. According to a particularly preferred embodiment of the invention, multi-channel conduit 14 is made of extruded metal, and most preferably, an aluminum alloy. Multi-channel conduit 14 comprises core 44, interior walls 46 extending radially therefrom, and circumferential conduit wall 48. Multi-channel conduit 14 further comprises casing pressurization channel 30 and packing element pressurization channel 50. Packing element pressurization channel 50 communicates through packing element pressurization ports 52 with packing elements 24.

Although a number of devices are commercially available for use as packing elements 24 within the scope of the present invention, preferred packing elements 24 for use with the present invention are bladder packers or cup seal packers. A bladder packer is shown in FIG. 3. Referring to FIG. 3, the bladder packer comprises an inflatable elastomeric bladder 54 disposed around a central body having a cross-section like that of multi-channel conduit 14 and affixed thereto by means of bladder clamp rings 56. Bladder clamp rings 56 are attached by means of screws 58 or other suitable mechanical fasteners to conduit wall 48. Protective shoulders 60 on conduit wall 48 are further provided above and below bladder clamp rings 56 to protect bladder 54 when either raising or lowering multi-channel conduit 14 through casing 10.

As shown in FIGS. 2–3, packing element 24 is in its "unset" position. When packing element 24 is in the appropriate downhole position and ready to be "set", a fluid such as, for example, compressed air is injected from a packing element pressurization source at the surface (not shown), through packing element pressurization channel 50, packing element pressurization ports 52 and against the inside surface of bladder 54. Bladder 54 is thereby distended outward so as to provide sealing engagement with the interior wall of casing 10.

Although it may be possible in some applications and with some materials to manufacture the multi-channel conduit disclosed herein as flexible tubing, in the preferred embodiment multi-channel conduit 14 is manufactured in substantially rigid sections having a length approximating that of standard, commercially available drilling pipe. For proper functioning of the apparatus disclosed herein and practicing the method of the invention, it is vital that the joints of multi-channel conduit 14 be correctly aligned and properly sealed to prevent escape of the fluid prior to being injected into the treatment zones, and to maintain pressurization in the casing and packing elements.

Figure 4:
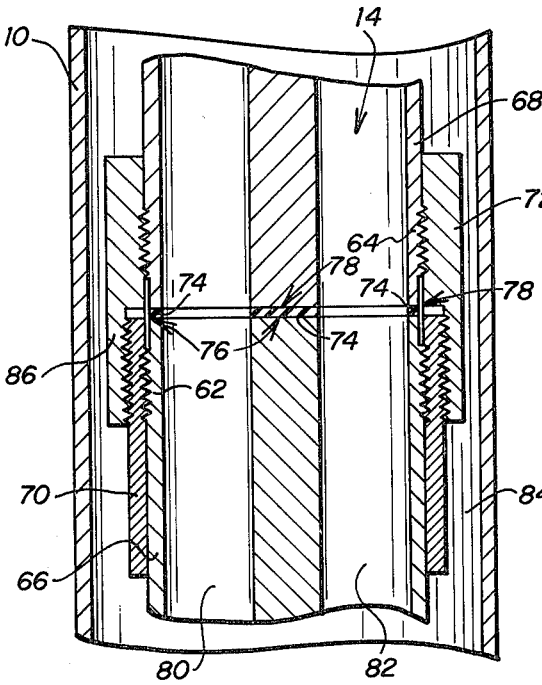
FIG. 4 is a sectional elevation view of an apparatus for connecting adjacent segments of the multi-channel conduit of the invention.

Referring to FIG. 4, in a preferred embodiment ends 62, 64 of adjacent sections 66, 68 comprising a segment of multi-channel conduit 14 are threaded to facilitate joinder of sections 66, 68 in a sealing and abutting relationship prior to lowering the connected sections into casing 10. While threaded end 62 of section 66 is still above the surface, dual threaded sleeve 70 is brought into threaded engagement therewith. Similarly, threaded collar 72 is brought into threaded engagement with threaded end 64 of section 68. Sealing element 74 is thereafter inserted between facing end surfaces 76, 78 of sections 66, 68, respectively, so as to provide a pressure-tight seal capable of partitioning and maintaining pressure-tight seals between fluid injection channels 80, 82 and annular space 84 in casing 10. Once sealing element 74 is positioned, threaded bell portion 86 of threaded collar 72 is brought into threaded engagement with the outer threaded surface of the dual threaded sleeve 70, thereby bringing facing end surfaces 76, 78 of sections 66, 68 of multi-channel conduit 14 into a sealing and abutting relationship.

Figure 5:
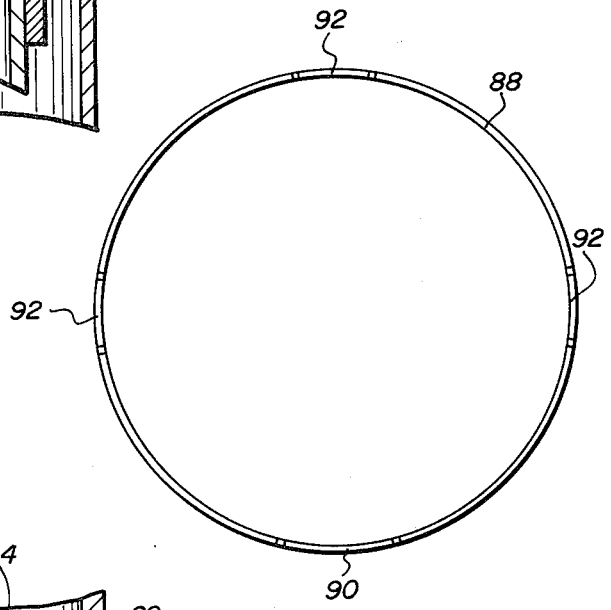
FIG. 5 is a plan view of a meshing ring used to achieve proper alignment when connecting adjacent segments of the multi-channel conduit of the invention.
Figure 6:
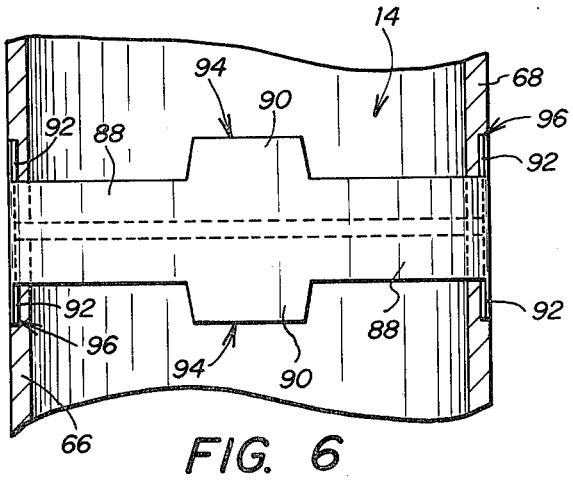
FIG. 6 is a sectional elevation view showing the meshing ring of FIG. 5 in place between two adjacent sections of conduit.

Because it is important that the channels of abutting sections of the multi-channel conduit of the invention be properly aligned, an alignment device such as, for example, key guides or a joint meshing ring are preferably employed. FIGS. 5–6 depict a meshing ring that is suitable for use in accordance with a preferred embodiment of the present invention. Meshing ring 88 preferably has a circular cross section with an outside diameter approximately equal to the outside diameter of multi-channel conduit 14 with which it is employed. Meshing ring 88 further comprises a plurality of teeth 90, 92 adapted to be received into recesses 94, 96 in the outside wall of sections 66, 68 of multi-channel conduit 14. According to a particularly preferred embodiment of the invention, the width of one tooth 90 is substantially greater than the width of remaining teeth 92 so as to facilitate rapid positioning of meshing ring 88 in its most preferred alignment relative to sections 66, 68 of multi-channel conduit 14. Similarly, recesses 94 are sized to accommodate tooth 90 so as to insure that the internal channels of multi-channel conduit 14 are properly aligned.

In the event that packing elements 24 fail to release once the pressure is bled from packing element pressurization channel 50, or in the event that some downhole obstruction or other unexpected occurrence prevents the operator from removing or otherwise repositioning multi-channel conduit 14 once it has been lowered into casing 10, a back-off joint 98 is provided.

Figure 7:
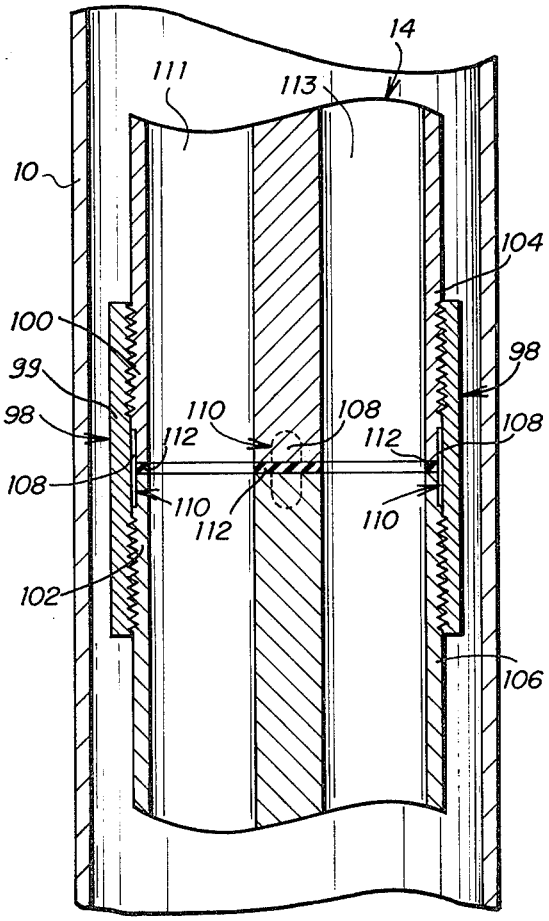
FIG. 7 is a front elevation view of a back-off joint for use in combination with the subject multi-channel conduit in practicing the method of the invention.

Referring to FIG. 7, back-off joint 98 can be utilized between any two adjacent sections of multi-channel conduit 14. Preferably, back-off joint 98 is employed just above any apparatus in the string that is more prone to malfunction or hangup downhole. Back-off joint 98 preferably comprises a dual threaded collar 99 for threaded engagement with threaded end portions 100, 102 of adjacent sections 104, 106 of multi-channel conduit 14. According to a particularly preferred embodiment of the invention, dual threaded collar 99 comprises left hand internal threads adapted for threaded engagement with left hand threaded end portion 100 of section 104, and right hand internal threads adapted for threaded engagement with right hand threaded end portion 102 of section 106. Back-off joint 98 further comprises shearable keys 108 that may be used either alone or in combination. A key guide 110 is provided in sections 104, 106 for each shearable key 108 employed in back-off joint 98. Back-off joint 98 further comprises sealing element 112 to maintain pressurization and separation between channels 111, 113 and the annular space inside casing 10. The shear strength of shearable keys 108 is such that the combined resistance to rotation of the sealing element and the shearable keys will be less than the torsional stress required to permanently deform multi-channel conduit 14. Where multiple back-off joints are used in a string, proper gradation of the key strengths will permit "back-off" to take place at the desired depth. When thus employed, combined shear strengths should increase with increasing depth. In order to achieve proper alignment and sealing, back-off joint 98 is preferably assembled prior to shipment to the field. It is further understood that either of the conduit sections in threaded engagement with the dual threaded sleeve of the subject back-off joint can comprise the threaded end portion of a packing element 24 within the scope of the invention.

For some applications, it may be preferable to use a "hard metal" as opposed to "soft metal" embodiment of the multi-channel conduit of the invention. Where it is impossible to extrude the material of construction in making the multi-channel conduit of the invention, an alternate embodiment comprising a plurality of separately manufactured tubes fixed in a nesting relationship to each other inside a substantially cylindrical outer shell can be successfully employed. Referring to FIGS. 8 and 9, tubes 114 are disposed within cylindrical shell 116, which is in turn disposed within packing element 118, which is in turn disposed within casing 120. Disposed within tubes 114 are casing pressurization channel 122 and packing element pressurization channel 124. These channels are preferably disposed within conventional metal tubing such as that employed for tubes 114. Packing element pressurization channel 124 communicates through packing pressurization slot 126 with bladder 128 of packing element 118. Casing pressurization channel 122 functions in the same way as casing pressurization channel 30 in FIGS. 2–3. Packing element 118 is attached to multi-channel conduit 130 in the same manner as described for packing element 24 in connection with multi-channel conduit 14 as shown in FIGS. 2–3 above.

Tubes 114 in FIGS. 8–9 can be conventional commercially available tubing that has been reshaped to a form required for proper nesting inside cylindrical shell 116. Although six fluid injection channels are shown in the embodiment depicted in FIGS. 8 and 9, it is understood that more or fewer tubes can be employed within the scope of the invention. Tubes 114 are preferably permanently joined such as by welding or the like to form a single pressure-tight unit.

The apparatus disclosed herein encompasses a number of design innovations that are not present in conventional fluid injection apparatus. The unified conduit design insures near equal temperature distribution in the conduit at any point in the casing. This eliminates cumulative expansion differentials that would be present if separate conductor pipes were employed. As fluid is transported through the separate channels of the multi-channel conduit, the treatment zones throughout the well are brought up to operating temperatures before the packing elements are set. The string is then set "hot" rather than "cold" as might otherwise be the case. If thermal conditions in the well are changed, the packer string can be unset and reset at any time by controls at the wellhead.

In the embodiment disclosed in FIGS. 2 and 3, the multi-channel conduit is a "one piece" extrusion. The packer body is also a "one piece" extrusion having an interior identical to that of the multi-channel conduit. With the apparatus of the present invention, there are no moving parts in the system that are downhole other than the packing element. Since all flow controls are at the wellhead, flow rates, pressures, and temperatures can be changed when and as desired. Flow rates may be controlled by simple chokes of the appropriate size. If greater flexibility and/or flow accuracy is desired, more complex mechanical flow regulators, flow meters, pressure gauges, temperature controllers, and alike can be employed.

When utilizing the "hard metal" embodiment of the invention, the multi-channel conduit can be handled by conventional tongs, slips, and hoists without taking any special precautions. When utilizing the "soft metal" embodiment, however, some precautions should desirably be taken to avoid deformation of the multi-channel conduit. According to a preferred embodiment of the invention, unions and back-off joints comprising outer collars of "hard metal" are used to permit handling with conventional tongs and hoists. In some instances, special slips having resilient seats may desirably be used.

Through use of the apparatus as disclosed herein, flow variations into individual zones are easily identified and monitored. Furthermore, flow rates into different zones can be easily varied at the discretion of the operator. Unlike the present practice with some conventional injection equipment, it is no longer necessary to bring in a wireline truck and crew to retrieve and reinstall downhole regulators in order to achieve different flow parameters. Moreover, flow regulator malfunctions experienced with downhole equipment are difficult to identify and can result in partial failure of the operator's planned injection profile.

A method for introducing fluid through a wellbore into a plurality of hydrocarbon-containing subsurface formations is also provided. Referring again to FIG. 1, a multi-channel conduit 14 adapted to transport fluid from the surface to a plurality of subsurface treatment zones is emplaced in a well by insertion into the aperture defined by casing 10. Fluid is thereafter introduced at the wellhead into at least two channels of multi-channel conduit 14 and transported, generally under pressure, from the surface to the treatment zones where it is released through feed line vent ports 16 and casing perforations 18 into the subsurface formations. Fluids suitable for use in the method of the invention include, for example, steam, hot water, natural gas, carbon dioxide, and the like. When multi-channel conduit 14 of the invention is used for supplying fluids to downhole steam generators, fluids can include fuel gas and oxidizing gas as well as water. Preferred fluids for use with the process of the invention are steam and carbon dioxide. The fluid temperatures and pressures employed in accordance with the process of the invention can vary greatly depending upon the particular fluid, the downhole conditions, the physical characteristics of the subsurface formations, the internal geometry of the multi-channel conduit, and numerous other factors.

While the present invention has been described above in relation to its preferred embodiment, various modifications thereof will be apparent of those to ordinary skill in the art upon reading this application, and it is intended to cover all such modifications as fall within the scope of the appended claims.

What is claimed is:

1. An apparatus for injecting fluid into hydrocarbon-containing subsurface formations, said apparatus comprising:

(a) A multi-channel conduit adapted to simultaneously transport fluid from a wellhead to a plurality of treatment zones within a wellbore;

(b) A wellhead fitting communicating with the multi-channel conduit, said wellhead fitting adapted to introduce fluid into at least two channels of said multi-channel conduit;

(c) Packing elements for confining fluid transported through each channel of said multi-channel conduit to a single treatment zone within the wellbore; and (d) Back-off means positioned above each of said packing elements, said back-off means being adapted to disengage said multi-channel conduit from said packing element when subjected to a rotational shearing force less than the torsional stress required to permanently deform said multi-channel conduit.

* * * * *